US005120111A

United States Patent [19]

Cook

[11] Patent Number: 5,120,111

[45] Date of Patent: Jun. 9, 1992

[54] INFLATABLE SEAT

[76] Inventor: Christopher A. Cook, 1842 Rogue River Cir., Ventura, Calif. 93004

[21] Appl. No.: 714,918

[22] Filed: Jun. 13, 1991

[51] Int. Cl.[5] ..... A47C 7/02

[52] U.S. Cl. ..... 297/452; 297/188; 297/DIG. 3; 5/449; 5/507.1

[58] Field of Search ..... 297/452, 219, DIG. 3, 297/188; 248/311.2; 441/41; 5/449, 462, 441, 507, 458, 451, 455

[56] References Cited

U.S. PATENT DOCUMENTS

| | | | |
|---|---|---|---|
| 623,548 | 4/1899 | Hurdel | 5/449 |
| 1,644,096 | 10/1927 | Voit | 5/449 |
| 3,253,861 | 5/1966 | Howard | 297/219 |
| 3,508,732 | 4/1970 | Trachtenberg et al. | 248/311.2 X |
| 3,761,975 | 10/1973 | Personett | 5/449 |
| 3,833,947 | 9/1974 | Sorensen | 5/449 |
| 4,405,129 | 9/1983 | Stuckey | 5/449 X |
| 4,484,781 | 11/1984 | Phelps | 297/452 |
| 4,596,370 | 6/1986 | Adkins | 248/311.2 |
| 4,629,153 | 12/1986 | Marcum | 248/311.2 X |
| 4,883,205 | 11/1989 | Saelens et al. | 248/311.2 X |

FOREIGN PATENT DOCUMENTS

| | | | |
|---|---|---|---|
| 1929919 | 12/1969 | Fed. Rep. of Germany | 5/449 |

*Primary Examiner*—Kenneth J. Dorner
*Assistant Examiner*—Milton Nelson, Jr.
*Attorney, Agent, or Firm*—Leon Gilden

[57] ABSTRACT

An inflatable portable seat is readily transported for use in a desired environment, with the seat including planar top and bottom walls and an arcuate forward wall. An inflation valve is arranged for inflation of the seat structure, wherein the seat structure is arranged for interfolding and transported in an associated container. A modification of the seat includes an elastomeric strap for mounting of the container when the seat is inflated for convenient storage of the container and may be further provided with a polymeric foam sleeve mounted about the container for removal from the container and support of a beverage container therewithin and mounted within a further elastomeric strap within a side wall of the seat structure when inflated.

1 Claim, 5 Drawing Sheets 21
10b
C
20
27
26
25
10b
15
24
14
13
23

INFLATABLE SEAT

BACKGROUND OF THE INVENTION

1. Field of the Invention

The field of invention relates to portable seat structure, and more particularly pertains to a new and improved inflatable seat wherein the same is arranged for selective inflation for use.

2. Description of the Prior Art

Sporting events, entertainment, and the like are frequently performed in forums not availed of cushion seat structure. Various seat structure is provided in the prior art, but is typically of a cumbersome construction discouraging ease of transport. Examples of the prior art include U.S. Pat. No. 3,594,039 to Harp wherein a stadium seat structure is arranged with a seat and back portion, each including a storage container, with the seat and back portion arranged for interfolding relative to one another.

U.S. Pat. No. 3,338,629 to Drees sets forth an automotive utility unit arranged with a padded top lid for support upon a seat structure within an automotive environment.

U.S. Pat. No. 2,558,315 to Pabey, et al. sets forth a seat structure wherein a base plate frame is arranged for mounting upon a stadium bench including a back rest portion mounted thereto.

U.S. Pat. No. 2,612,207 to Branson sets forth a seat structure arranged for mounting upon a bumper of an associated automobile.

As such, it may be appreciated that there continues to be a need for a new and improved inflatable seat as set forth by the instant invention which addresses both the problems of ease of use as well as effectiveness and arranged for ease of transport and storage during periods of non-use and in this respect, the present invention substantially fulfills this need.

SUMMARY OF THE INVENTION

In view of the foregoing disadvantages inherent in the known types of seat apparatus now present in the prior art, the present invention provides an inflatable seat wherein the same includes an inflatable pneumatic chamber arranged for inflation during periods of use and deflation for storage within an associated container structure. As such, the general purpose of the present invention, which will be described subsequently in greater detail, is to provide a new and improved inflatable seat which has all the advantages of the prior art seat structures and none of the disadvantages.

To attain this, the present invention provides an inflatable portable seat readily transported for use in a desired environment, with the seat including planar top and bottom walls and an arcuate forward wall. An inflation valve is arranged for inflation of the seat structure, wherein the seat structure is arranged for interfolding and trasported in an associated container. A modification of the seat includes an elastomeric strap for mounting of the container when the seat is inflated for convenient storage of the container and may be further provided with a polymeric foam sleeve mounted about the container for removal from the container and support of a beverage container therewithin and mounted within a further elastomeric strap within a side wall of the seat structure when inflated.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved inflatable seat which has all the advantages of the prior art seat structures and none of the disadvantages.

It is another object of the present invention to provide a new and improved inflatable seat which may be easily and efficiently manufactured and marketed.

It is a further object of the present invention to provide a new and improved inflatable seat which is of a durable and reliable construction.

An even further object of the present invention is to provide a new and improved inflatable seat which is susceptible of a low cost of manufacture with regard to both materials and labor, and which accordingly is then susceptible of low prices of sale to the consuming public, thereby making such inflatable seats economically available to the buying public.

Still yet another object of the present invention is to provide a new and improved inflatable seat which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
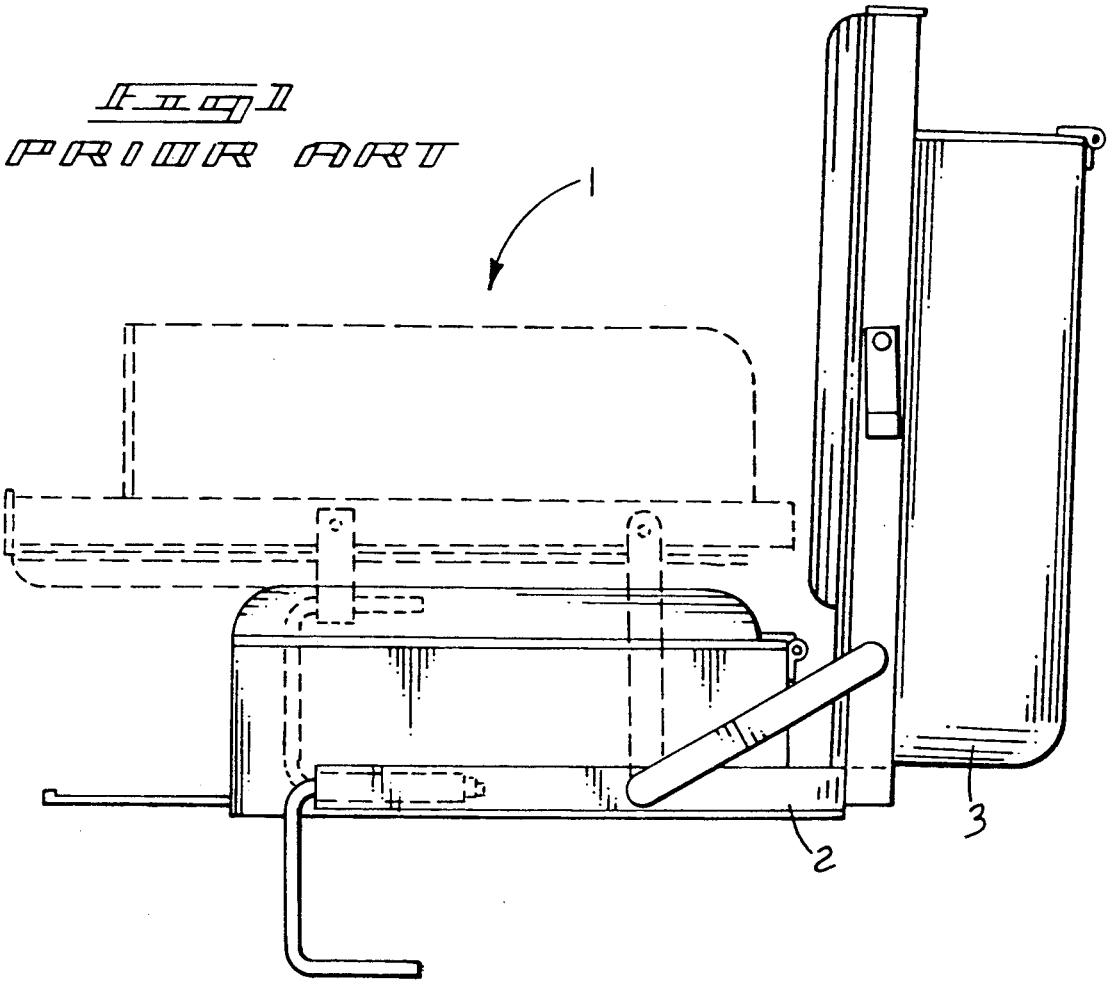
Fig 1 PRIOR ART
FIG. 1 is an orthographic side view of a prior art portable seat structure.
Figure 2:
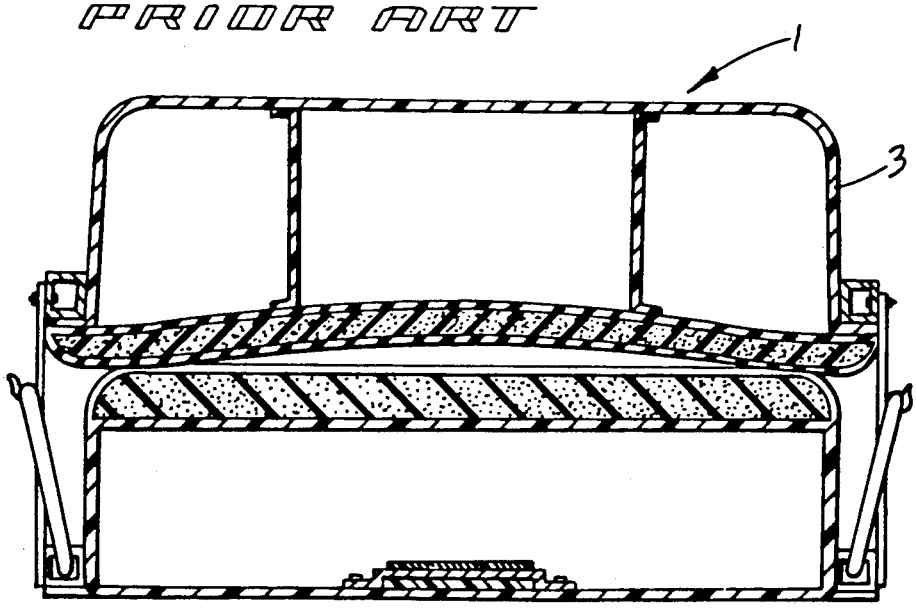
Fig 2 PRIOR ART
FIG. 2 is an orthographic frontal view of the portable seat structure as set forth in FIG. 1 in a folded configuration.
Figure 3:
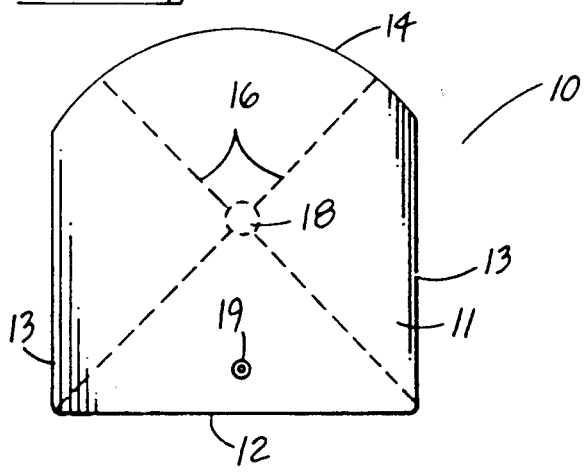
FIG. 3 is an orthographic bottom view of the invention.
Figure 4:
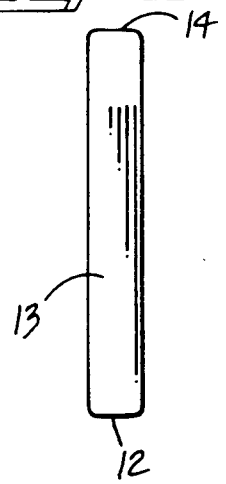
FIG. 4 is an orthographic side view of the invention.
Figure 5:
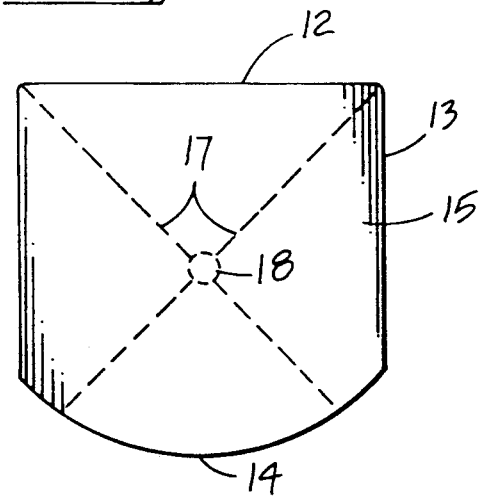
FIG. 5 is an orthographic top view of the invention.

With reference now to the drawings, and in particular to FIGS. 1 to 12 thereof, a new and improved inflatable seat embodying the principles and concepts of the present invention and generally designated by the reference numeral 10 will be described.

FIG. 1 illustrates a prior art stadium seat, as set forth in U.S. Pat. No. 3,594,039, wherein the stadium seat includes a base portion 2 mounted to a back rest portion 3, wherein each of the portions 2 and 3 include storage containers, as well as a padded seat structure folded relative to one another.

Figure 6:
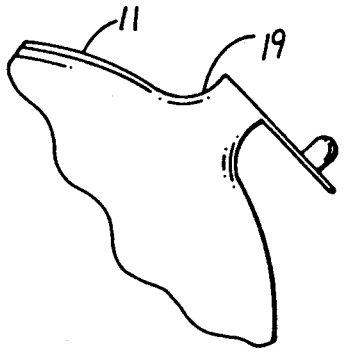
FIG. 6 is an orthographic side view of the inflation valve utilized by the instant invention in a first position.
Figure 7:
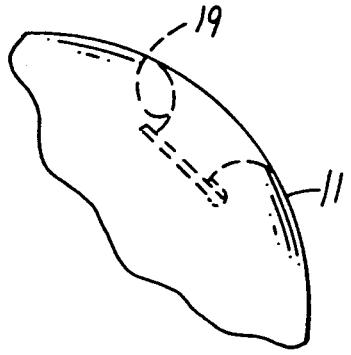
FIG. 7 is an orthographic side view of the inflation valve in a second position.

More specifically, the inflatable seat 10 of the instant invention essentially comprises a pneumatic chamber that includes a bottom wall 11 spaced from and parallel to a top wall 15. A rear wall 12 is orthogonally arranged relative to parallel spaced side walls 13, with an arcuate forward wall 14 directed between the side walls in a spaced relationship relative to the rear wall 12. Cross top seams 16 and cross bottom seams 17 are formed within the respective bottom and top walls 11 and 15 respectively and intersect at an annular intersection button 18 to provide rigidity and geometric integrity to the construction in use. An inflation valve 19 is directed through the bottom wall 11 and, as illustrated in FIGS. 6 and 7, is displaced from a first projecting position for inflation of the pneumatic chamber defined by the seat structure to a second retracted position, as illustrated in FIG. 9, projecting below the bottom wall 11 in use.

Figure 8:
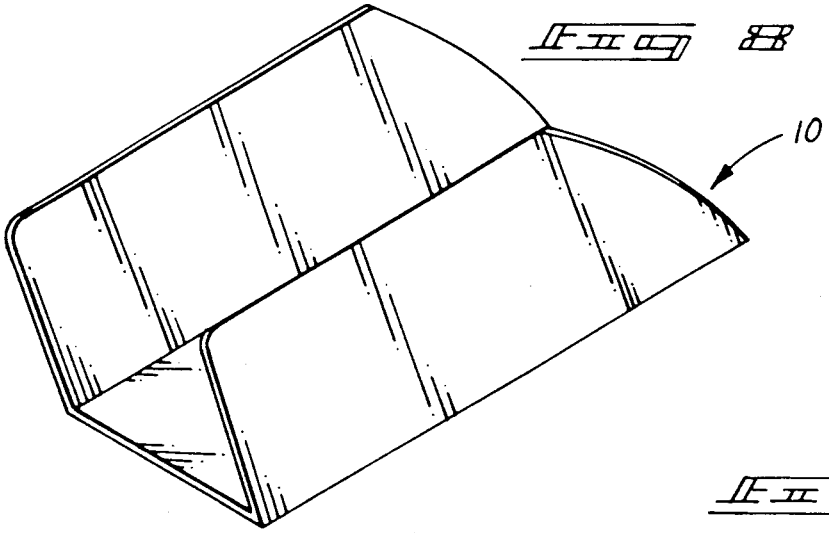
FIG. 8 is an isometric illustration of the seat in a deflated configuration.
Figure 9:
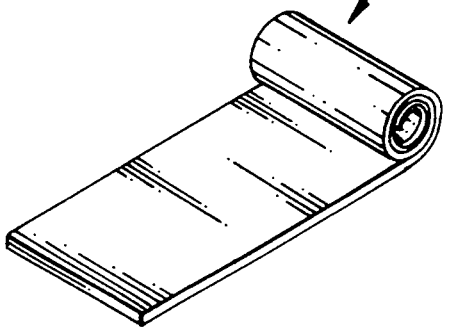
FIG. 9 is an isometric illustration of the inflation seat in a rolled configuration.
Figure 10:
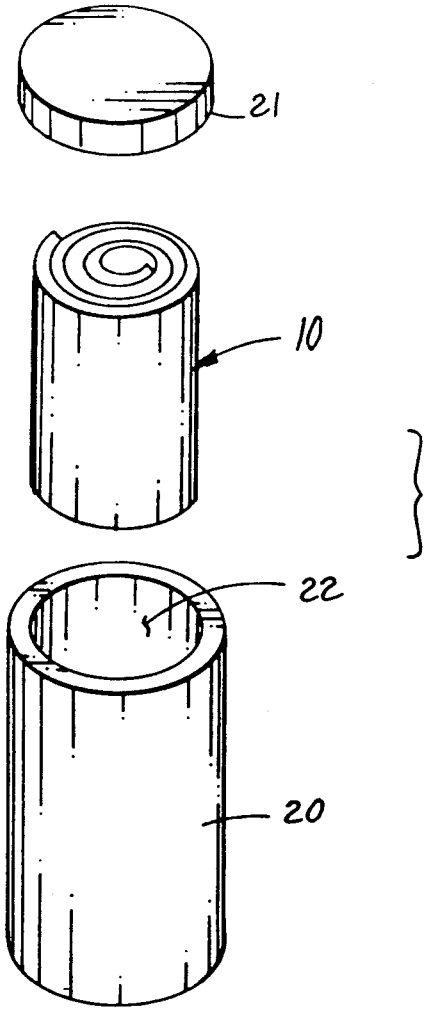
FIG. 10 is an isometric illustration of the inflation seat arranged for positioning within an associated storage container.

FIG. 8 illustrates the seat structure 10 deflated for inter-folding relative to itself and subsequently rolled, in a manner as illustrated in FIG. 9, into a tubular configuration for positioning within a rigid cylindrical first container 20 defined by a predetermined first height and a predetermined first diameter. A cylindrical cap 21 is positionable over an upper annular edge of the first container 20 when the seat 20 is positioned within the first container's cavity 22.

Figure 11:
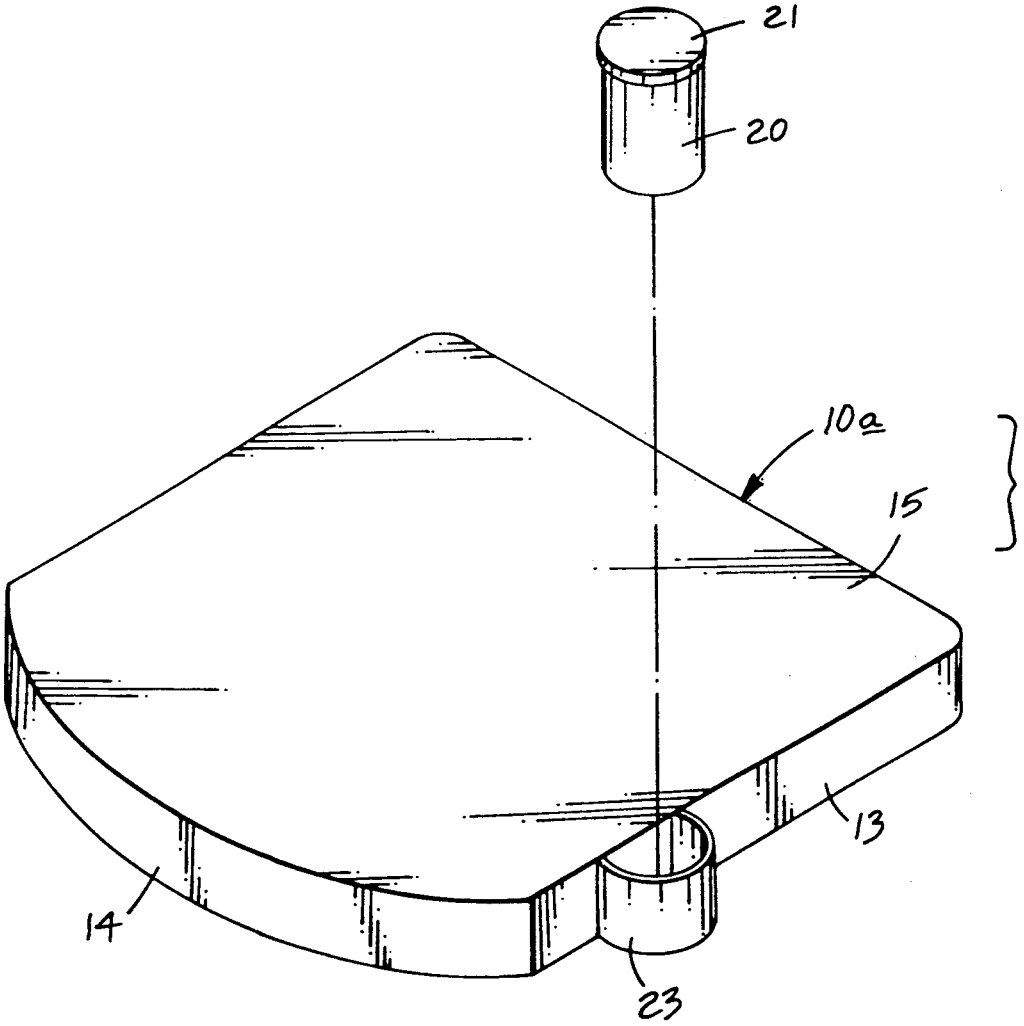
FIG. 11 is an isometric illustration of a modification of the inflation seat of the invention.

FIG. 11 illustrates a modified seat construction **10*a* that includes an elastomeric first strap 23 for mounting the first container 20 therewithin when the seat 10*a* is removed from the container permitting ease of storage for the container 20** prior to its reuse.

Figure 12:
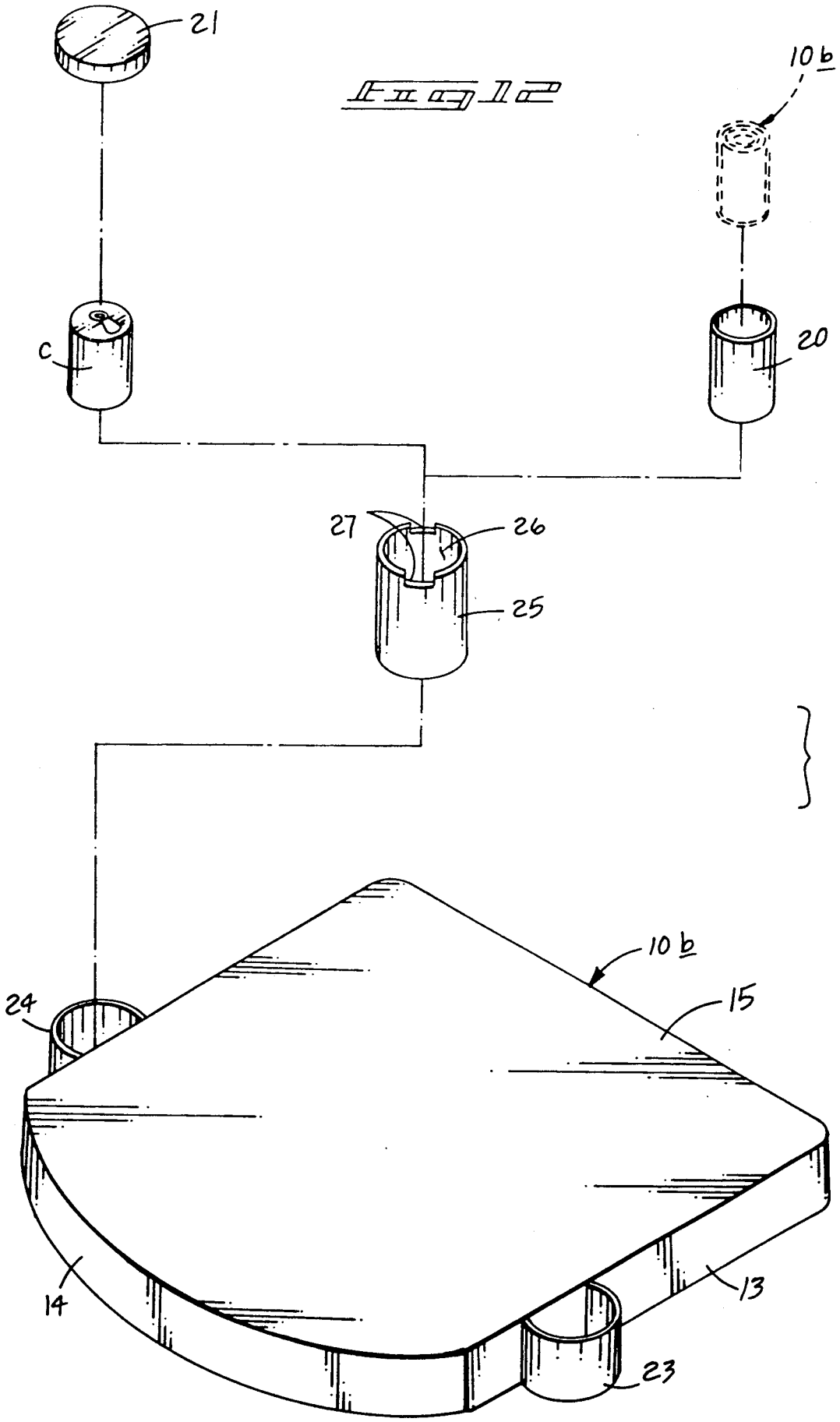
FIG. 12 is an isometric illustration of a further modification of the inflation seat of the invention.

FIG. 12 illustrates a further modified seat construction **10*b* employing an elastomeric second strap 24. The container 20 is received within a cylindrical second container 25 formed of insulative polymeric foam material for positioning a beverage container "C" therewithin. The second container 25 includes a plurality of access slots 27 diametrically directed within the upper annular edge of the second container 25. The second container 25 is defined by a predetermined second height less than the first height, whereupon positioning of the first container 20 within the second container 25, the first container extends above the upper terminal end of the second container to permit reception of the cap 21 thereon. Subsequently, the first container 20 may positioned within the first elastomeric strap 23, in a manner as illustrated in FIG. 11. The second container 25 defined by a second diameter greater than the first diameter to complementarily receive the second container therewithin is subsequently positionable within the second elastomeric strap 24 when accommodating a beverage container "C" therewithin. In this manner, the first and second containers are mounted within the seat construction 10*b* during its use. For transport and storage of the modified seat construction 10*b*, the container is inter-folded and rolled, in a manner as illustrated in FIGS. 8 and 9, and subsequently positioned within the second container 25**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An inflatable seat, comprising in combination, a bottom wall defined by a first configuration, and a top wall defined of a configuration equal to the first configuration coextensive with the bottom wall, and a rear wall, spaced parallel side walls, and an arcuate forward wall, wherein the seat defines a pneumatic chamber, the bottom wall and top wall include respective top and bottom crossed seams, the crossed seams intersecting at an annular intersecting button to effect geometric integrity to the seat upon inflation, and the bottom wall including an inflation valve, the inflation valve projecting exteriorly of the bottom wall in a first position, and projected within the seat to a retracted second position below the bottom wall, and including a cylindrical first container, the cylindrical first container defined by a predetermined first height and predetermined first diameter, and the first container including a first container cavity, the seat arranged for inter-folding in a deflated first position for reception within the first container cavity, and a cylindrical cap mounted to the first container at an upper terminal end of the first container, and one of said side walls including a first elastomeric strap, the first container mounted within the first elastomeric strap when the seat is in the inflated second position, and including a second container, the second container defined by a predetermined second height less than the first height, and a second diameter greater than the first diameter for complementarily receiving the first container within the second container, and the second container including a second container upper terminal end, and a plurality of access slots directed diametrically within the second container upper terminal end for gaining manual access to a beverage container positioned within the second container cavity, and a second elastomeric strap mounted to one of said side walls for mounting the second container therewithin, wherein the second container includes a beverage container positioned therewithin.

* * * * *